US010391606B2

(12) United States Patent
Weis et al.

(10) Patent No.: US 10,391,606 B2
(45) Date of Patent: Aug. 27, 2019

(54) CHEMICAL MECHANICAL POLISHING PADS FOR IMPROVED REMOVAL RATE AND PLANARIZATION

(71) Applicants: Rohm and Haas Electronic Materials CMP Holdings, Inc., Newark, DE (US); Dow Global Technologies LLC, Midland, MI (US)

(72) Inventors: Jonathan G. Weis, Bear, DE (US); Nan-Rong Chiou, Wilmington, DE (US); George C. Jacob, Newark, DE (US); Bainian Qian, Newark, DE (US)

(73) Assignees: Rohm and Haas Electronic Materials CMP Holdings, Inc., Newark, DE (US); Dow Global Technologies LLC, Midland, MI (US)

( * ) Notice: Subject to any disclaimer, the term of this patent is extended or adjusted under 35 U.S.C. 154(b) by 297 days.

(21) Appl. No.: 15/615,254

(22) Filed: Jun. 6, 2017

(65) Prior Publication Data

US 2018/0345448 A1 Dec. 6, 2018

(51) Int. Cl.

*B24B 37/24* (2012.01)
*B24B 37/04* (2012.01)
*B24B 37/22* (2012.01)

(52) U.S. Cl.

CPC ..... *B24B 37/24* (2013.01); *B24B 37/042* (2013.01); *B24B 37/22* (2013.01)

(58) Field of Classification Search

CPC ..... B24B 37/24; B24B 37/22; B24B 37/042
USPC ..... 451/41, 526, 527, 528, 529, 533, 534; 51/293, 297, 298
See application file for complete search history.

(56) References Cited

U.S. PATENT DOCUMENTS

| | | | | |
|---|---|---|---|---|
| 3,252,848 | A | 5/1966 | Borsellino | |
| 3,711,511 | A | 1/1973 | Farah | |
| 3,947,426 | A | 3/1976 | Lander | |
| 6,046,297 | A | 4/2000 | Rosenberg et al. | |
| 6,280,290 | B1 * | 8/2001 | Birang | B24B 37/013 451/6 |
| 6,860,802 | B1 | 3/2005 | Vishwanathan et al. | |
| 6,984,163 | B2 * | 1/2006 | Roberts | B24B 37/205 451/28 |
| 7,169,030 | B1 | 1/2007 | Kulp | |
| 7,445,847 | B2 | 11/2008 | Kulp | |
| 7,762,870 | B2 | 7/2010 | Ono et al. | |
| 8,647,179 | B2 | 2/2014 | Nakayama et al. | |
| 8,697,239 | B2 | 4/2014 | Kulp et al. | |
| 8,715,035 | B2 | 5/2014 | Roy et al. | |
| 8,864,859 | B2 | 10/2014 | Roy et al. | |
| 9,102,034 | B2 | 8/2015 | Jensen et al. | |
| 2004/0058623 | A1 | 3/2004 | Lin et al. | |
| 2006/0089093 | A1 | 4/2006 | Swisher et al. | |
| 2015/0059254 | A1 | 3/2015 | Yeh et al. | |

FOREIGN PATENT DOCUMENTS

| | | | |
|---|---|---|---|
| JP | 2013252584 | A | 12/2013 |
| JP | 05501722 | B2 | 5/2014 |
| WO | 2015/037606 | A1 | 3/2015 |

* cited by examiner

*Primary Examiner* — Robert A Rose
(74) *Attorney, Agent, or Firm* — Simon L. Xu; Andrew Merriam

(57) ABSTRACT

The present invention provides a chemical mechanical (CMP) polishing pad for polishing three dimensional semiconductor or memory substrates comprising a polishing layer of a polyurethane reaction product of a thermosetting reaction mixture of a curative of 4,4'-methylenebis(3-chloro-2,6-diethylaniline) (MCDEA) or mixtures of MCDEA and 4,4'-methylene-bis-o-(2-chloroaniline) (MbOCA), and a polyisocyanate prepolymer formed from one or two aromatic diisocyanates, such as toluene diisocyanate (TDI), or a mixture of an aromatic diisocyanate and an alicyclic diisocyanate, and a polyol of polytetramethylene ether glycol (PTMEG), polypropylene glycol (PPG), or a polyol blend of PTMEG and PPG and having an unreacted isocyanate (NCO) concentration of from 8.6 to 11 wt. %. The polyurethane in the polishing layer has a Shore D hardness according to ASTM D2240-15 (2015) of from 60 to 90, a shear storage modulus (G') at 65° C. of from 125 to 500 MPa, and a damping component (G"/G' measured by shear dynamic mechanical analysis (DMA), ASTM D5279-08 (2008)) at 50° C. of from 0.06 to 0.13.

10 Claims, No Drawings

CHEMICAL MECHANICAL POLISHING PADS FOR IMPROVED REMOVAL RATE AND PLANARIZATION

The present invention relates to chemical mechanical polishing pads and methods of using the same. More particularly, the present invention relates to a chemical mechanical polishing pad having a low damping component comprising a polishing layer or top polishing surface of a polyurethane reaction product of a thermosetting reaction mixture comprising a curative of 4,4'-methylenebis(3-chloro-2,6-diethylaniline) (MCDEA) or mixtures of MCDEA and 4,4'-methylene-bis-o-(2-chloroaniline) (MbOCA) and a polyisocyanate prepolymer formed from a polyol of polytetramethylene ether glycol (PTMEG), polypropylene glycol (PPG) or a polyol blend of PTMEG and PPG and an aromatic diisocyanate or combination of aromatic diisocyanate and alicyclic diisocyanate and having from 8.6 to 11 wt. % content of unreacted isocyanate (NCO) of, and methods of using the pad to polish three dimensional semiconductor or memory substrates, such as non-volatile flash memory (e.g., 3D NAND) substrates.

In the production of any semiconductor or memory device, several chemical mechanical polishing (CMP polishing) processes may be needed. In each CMP process, a polishing pad in combination with a polishing solution, such as an abrasive-containing polishing slurry or an abrasive-free reactive liquid, removes excess material in a manner that planarizes or maintains flatness of the substrate. The stacking of multiple layers in semiconductors combines in a manner that forms an integrated circuit. The fabrication of such semiconductor devices continues to become more complex due to requirements for devices with higher operating speeds, lower leakage currents and reduced power consumption.

The advent of three-dimensional memory architectures (e.g., 3D-NAND) and dimensionally stacked memory cells or arrays has resulted in the need for CMP polishing of substrates having broad lateral dimensions. Such substrates require feature or die scale planarization at lateral dimensions of, for example, from 1-50 mm between features needing planarized. In particular, 3D NAND memory substrates having at least a low area of from 1 to 5 mm in width have generated new geometries for CMP polishing. Such geometries will include significantly thicker oxide films (>1 μm) and wider lateral features (1-10 mm) that require feature scale planarization. The thick oxide films impose an extraordinarily high removal rate requirement; and the large features demand a new class of CMP polishing pad materials capable of planarizing lateral lengths orders of magnitude greater than previous CMP substrates.

U.S. Pat. Publication No. 2015/0059254 A1, to Yeh et al. discloses polyurethane polishing pads which comprise the polyurethane reaction product of a polyurethane prepolymer from polypropylene glycol and toluene diisocyanate and 4,4'-methylenebis(3-chloro-2,6-diethylaniline) (MCDEA) as the curative. The resulting CMP polishing pads enable improved polishing of metal containing substrates but do not provide the removal rates needed to effectively polish three-dimensional semiconductor or memory substrates having an oxide film at least 1 μm thick and at least one low area of from 1 to 5 mm in width.

The present inventors have sought to solve the problem of providing an effective chemical mechanical polishing (CMP polishing) pad that provides the necessary removal rate and wide scale planarization for polishing three dimensional semiconductor or memory substrates, such as non-volatile flash memory (3D NAND) substrates.

STATEMENT OF THE INVENTION

1. In accordance with the present invention, chemical mechanical (CMP) polishing pads having a low damping component for polishing a substrate chosen from at least one of a three dimensional memory and a semiconductor substrate comprise a polishing layer adapted for polishing the substrate which is a polyurethane reaction product of a thermosetting reaction mixture comprising a curative of 4,4'-methylenebis(3-chloro-2,6-diethylaniline) (MCDEA) or mixtures of MCDEA and 4,4'-methylene-bis-o-(2-chloroaniline) (MbOCA) in a weight ratio of MCDEA to MbOCA of from 3:7 to 1:0 or, preferably, from 4:6 to 1:0, and a polyisocyanate prepolymer having an unreacted isocyanate (NCO) concentration of from 8.6 to 11 wt. %, or, preferably, from 8.6 to 10.3 wt. % of the polyisocyanate prepolymer and formed from one or two aromatic diisocyanates, such as one chosen from methylene diphenyl diisocyanate (MDI); toluene diisocyanate (TDI); napthalene diisocyanate (NDI); paraphenylene diisocyanate (PPDI); or o-toluidine diisocyanate (TODI); a modified diphenylmethane diisocyanate, such as a carbodiimide-modified diphenylmethane diisocyanate, an allophanate-modified diphenylmethane diisocyanate, a biuret-modified diphenylmethane diisocyanate; or an aromatic isocyanurate from a diisocyanate, such as the isocyanurate of MDI, preferably, toluene diisocyanate (TDI) or a mixture of TDI and up to 20 wt. % of MDI, based on the total weight of the aromatic diisocyanates; or one or two aromatic diisocyanates, preferably, TDI or TDI and up to 20 wt. % of MDI, based on the total weight of aromatic diisocyanates, mixed with up to 67 wt. %, or preferably, 64.5 wt. % or less of an alicylic diisocyanate, such as, 4,4'-methylenebis(cyclohexyl isocyanate) ($H_{12}$-MDI) based on the total weight of the aromatic and any alicyclic diisocyanates; and a polyol of polytetramethylene ether glycol (PTMEG), polypropylene glycol (PPG), or a polyol blend of PTMEG and PPG as reactants, wherein the polyurethane reaction product in the polishing layer has a Shore D hardness (2 sec) according to ASTM D2240-15 (2015) of from 60 to 90 or, preferably from 70 to 80 and, further wherein the polyurethane reaction product in the polishing layer has a shear storage modulus (G') at 65° C. of from 125 to 500 MPa, or, preferably, up to 260 MPa.

2. In accordance with the chemical mechanical polishing pad of present invention as in item 1, above, wherein the stoichiometric ratio of the sum of the total moles of amine ($NH_2$) groups and the total moles of hydroxyl (OH) groups in the reaction mixture to the total moles of unreacted isocyanate (NCO) groups in the reaction mixture ranges from 0.85:1 to 1.20:1, or, preferably, from 1.00:1 to 1.10:1.

3. In accordance with the chemical mechanical polishing pad of present invention as in any one of items 1 or 2, above, wherein the polyol used to form the polyisocyanate prepolymer is chosen from (i) PTMEG, (ii) PPG or (iii) a polyol blend of PTMEG and PPG in a ratio of PTMEG to PPG of from 1:0 to 1:4, or, for example, from 12:1 to 1:1.

4. In accordance with the chemical mechanical polishing pad of present invention as in any one of items 1, 2, or 3, above, wherein the weight average molecular weight (GPC) of the PTMEG in the polyol or polyol blend ranges from 800 to 1600, or, preferably, from 1100 to 1500.

5. In accordance with the chemical mechanical polishing pad of present invention as in any one of items 1, 2, 3 or 4, above, wherein the polishing layer of the CMP polishing pad further comprises microelements chosen from entrapped gas bubbles, hollow core polymeric materials, such as polymeric microspheres, liquid filled hollow core polymeric materials, such as fluid-filled polymeric microspheres, and fillers, such as boron nitride, preferably, expanded fluid-filled polymeric microspheres.

6. In accordance with the chemical mechanical polishing pad of present invention as in item 5, above, wherein the amount of the microelements ranges from 0.4 to 2.5 wt. % or, more preferably, 0.75 to 2.0 wt. % of one or more microelements, based on the total weight of the reaction mixture.

7. In accordance with the chemical mechanical polishing pad of present invention as in any one of items 5 or 6, above, wherein the polishing pad or polishing layer has a density of 0.55 to 1.17 g/cm$^3$ or, preferably, from 0.70 to 1.08 g/cm$^3$.

8. In accordance with the chemical mechanical polishing pad of present invention as in any one of items 5, 6 or 7, above, wherein the polishing pad or polishing layer has a porosity of from 0.01 to 53% or, preferably, from 8 to 40%.

9. In accordance with the chemical mechanical polishing pad of the present invention as in any one of items 1, 2, 3, 4, 5, 6, 7 or 8, above, wherein the polishing layer comprises a polyurethane reaction product having a hard segment of from 45 to 70%, or preferably, 50 to 70% based on the total weight of the thermosetting reaction mixture.

10. In accordance with the chemical mechanical polishing pad of the present invention as in any one of items 1, 2, 3, 4, 5, 6, 7, 8, or 9, above, wherein the polishing layer has a damping component (G"/G' measured by shear dynamic mechanical analysis (DMA), ASTM D5279-08 (2008)) at 50° C. of from 0.06 to 0.13 or, preferably, from 0.068 to 0.118.

11. In another aspect, the present invention provides methods of polishing a substrate, comprising: Providing a substrate selected from at least one of a magnetic substrate, an optical substrate and a semiconductor substrate; providing a chemical mechanical (CMP) polishing pad according to any one of items 1 to 10, above; providing an abrasive polishing medium; creating dynamic contact between a polishing surface of the polishing layer of the CMP polishing pad, the abrasive polishing medium and the substrate to polish a surface of the substrate at a downforce of from 103 to 550 hPa (1.5 to 8 psi); and, conditioning of the polishing surface of the polishing pad with an abrasive conditioner.

12. In accordance with the methods of the present invention as in item 11, above, wherein the substrate comprises a three-dimensional semiconductor or memory substrate, such as, for example, 3D NAND memory.

13. In accordance with the methods of the present invention as in item 12, above, wherein the three-dimensional semiconductor or memory substrate comprises an oxide film at least 1 μm thick or, preferably, from 1 to 7 μm thick or, more preferably, 1 to 4 μm thick and has at least one low area of from 1 to 5 mm in width.

14. In accordance with the methods of the present invention as in any one of items 12 or 13, above, wherein the creating dynamic contact results in a removal rate of at least 8000 Å/minute or, preferably, at least 10,000 Å/minute.

15. In accordance with the methods of the present invention as in any one of items 12, 13, or 14 above, wherein the creating dynamic contact comprises providing an abrasive polishing medium, such as ceria, having a total abrasive solids content of from 0.5 to 7 wt. % and polishing at a downforce of from 103 to 550 hPa (1.5 to 8 psi), or, preferably, from 206 to 483 hPa (3 to 7 psi) with the abrasive polishing medium.

16. In accordance with the methods of the present invention as in item 15, above, wherein the creating dynamic contact comprises providing the abrasive polishing medium at an abrasive content of from 0.5 to 1.999 wt. % or, preferably, from 0.5 to 1.5 wt. % and polishing at a downforce of from 206 to 550 hPa (3 to 8 psi), or, preferably, from 275 to 483 hPa (4 to 7 psi).

17. In accordance with the methods of the present invention as in item 15, above, wherein the creating dynamic contact comprises providing the abrasive polishing medium at an abrasive content of from 2 to 6 wt. % or, preferably, from 2.5 to 5.5 wt. % and polishing at a downforce (DF) of from 103 to 344 hPa (1.5 to 5 psi) or, preferably, from 137 to 344 hPa (2 to 5 psi).

Unless otherwise indicated, conditions of temperature and pressure are ambient or room temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, the term "ASTM" refers to publications of ASTM International, West Conshohocken, Pa.

As used herein, the terms G', G", and G"/G' (which corresponds to tan delta), respectively, refer to shear storage modulus, shear loss modulus, and the ratio of the shear loss modulus to the shear storage modulus. Test specimens were cut with 6.5 mm width and 36 mm length. An ARES™ G2 torsional rheometer or a Rheometric Scientific™ RDA3 (both from TA Instruments, New Castle, Del.) were used in accordance with ASTM D5279-13 (2013), "Standard Test Method for Plastics: Dynamic Mechanical Properties: In Torsion." The gap separation was 20 mm. Instrument analysis parameters were set at 100 g of preload, 0.2% strain, oscillation speed of 10 rads/sec, and temperature ramp rate of 3° C./min from −100° C. to 150° C.

As used herein, the term "molecular weight" or "GPC", unless otherwise indicated, means the result determined by gel permeation chromatography of an analyte polyol (GPC) against polyether polyol or polyglycol, e.g. PEG, standards.

As used herein, the term "hard segment" of a polyurethane reaction product or a raw material from the thermosetting reaction mixture refers to that portion of the indicated reaction mixture which comprises any diol, glycol, diglycol, diamine, triamine or polyamine, diisocyanate, triisocyanate, or reaction product thereof. The "hard segment" thus excludes polyethers or polyglycols having three or more ether groups, such as polytetramethylene glycols or polypropylene glycols.

As used herein, the term "PPG" refers to any of poly (propylene glycol), ethylene oxide (EO) initiated PPG and (di)ethylene glycol extended PPG.

As used herein, the term "polyisocyanate" means any isocyanate group containing molecule having three or more isocyanate groups, including blocked isocyanate groups.

As used herein, the term "polyisocyanate prepolymer" means any isocyanate group containing molecule that is the reaction product of an excess of a diisocyanate or polyisocyanate with an active hydrogen containing compound containing two or more active hydrogen groups, such as diamines, diols, triols, and polyols.

As used herein, the term "polyurethanes" refers to polymerization products from difunctional or polyfunctional isocyanates, e.g. polyetherureas, polyisocyanurates, polyurethanes, polyureas, polyurethaneureas, copolymers thereof and mixtures thereof.

As used herein, the term "reaction mixture" includes any non-reactive additives, such as microelements or additives to boost modulus or flexural rigidity, such as boron nitride or a polymeric polyacid, such as poly(methacrylic acid) or salts thereof.

As used herein, the term "SG" or "specific gravity" refers to the weight/volume ratio of a rectangular cut out of a polishing pad or layer in accordance with the present invention.

As used herein, the term "Shore D hardness" is the 2 second hardness of a given material as measured according to ASTM D2240-15 (2015), "Standard Test Method for Rubber Property-Durometer Hardness". Hardness was measured on a Rex Hybrid hardness tester (Rex Gauge Company, Inc., Buffalo Grove, Ill.), equipped with a D probe. Six samples were stacked and shuffled for each hardness measurement; and each pad tested was conditioned by placing it in 50 percent relative humidity for five days at 23° C. before testing and using methodology outlined in ASTM D2240-15 (2015) to improve the repeatability of the hardness tests. In the present invention, the Shore D hardness of the polyurethane reaction product of the polishing layer or pad includes the Shore D hardness of that reaction product.

As used herein, the term "solids" refers to any materials that remain in the polyurethane reaction product of the present invention; thus, solids include reactive and non-volatile additives that do not volatilize upon cure. Solids exclude water, ammonia and volatile solvents.

As used herein, the term "step height" refers to a maximum difference in film height between the high and low area of the feature to be polished in a three dimensional semiconductor or memory substrate.

As used herein, the term "stoichiometry" of a reaction mixture refers to the ratio of molar equivalents of (free OH+free $NH_2$ groups) to free NCO groups in the reaction mixture.

As used herein, unless otherwise indicated, the term "substantially water free" means that a given composition has no added water and that the materials going into the composition have no added water. A reaction mixture that is "substantially water free" can comprise water that is present in the raw materials, in the range of from 50 to 2000 ppm or, preferably, from 50 to 1000 ppm, or can comprise reaction water formed in a condensation reaction or vapor from ambient moisture where the reaction mixture is in use.

As used herein, the term "use conditions" means the temperature and pressure at which one conducts CMP polishing of a substrate, or at which the polishing occurs.

As used herein, unless otherwise indicated, the term "viscosity" refers to the viscosity of a given material in neat form (100%) at a given temperature as measured using a rheometer, set at an oscillatory shear rate sweep from 0.1-100 rad/sec in a 50 mm parallel plate geometry with a 100 μm gap.

As used herein, unless otherwise indicated, the term "number average molecular weight" or "Mn" and "weight average molecular weight" or "Mw" means that value determined by gel permeation chromatography (GPC) at room temperature using an Agilent 1100 High Pressure Liquid Chromatogram (HPLC) (Agilent, Santa Clara, Calif.) equipped with an isocratic pump, an autosampler (Injection volume (50 μl) and a Series of 4 PL-Gel™ (7 mm×30 cm×5 μm) columns, each filled with a polystyrene divinyl benzene (PS/DVB) gel in a succession of pore sizes of 50, 100, 500 and then 1000 Å against a standard calibrated from a polyol mixture (1.5 wt. % in THF) of polyethylene glycols and polypropylene glycols as standards. For polyisocyanate prepolymers, the isocyanate functional (N═C═O) groups of the isocyanate samples were converted with methanol from a dried methanol/THF solution to non-reactive methyl carbamates.

As used herein, unless otherwise indicated, the term "wt. % NCO" refers to the amount of unreacted or free isocyanate groups a given polyisocyanate prepolymer composition.

As used herein, the term "wt. %" stands for weight percent.

In accordance with the present invention, a chemical mechanical (CMP) polishing pad has a top polishing surface comprising the reaction product of a reaction mixture of a curative of 4,4'-methylenebis(3-chloro-2,6-diethylaniline) (MCDEA) or MCDEA mixed with 4,4'-methylene-bis-o-(2-chloroaniline) (MbOCA) and a polyisocyanate prepolymer formed from a polytetramethylene ether glycol (PTMEG) polyol, polypropylene glycol (PPG) or a polyol blend of PTMEG and PPG. The polishing layer in accordance with the present invention maintains a favorable shear storage modulus, measured as G', and a low damping component (from 0.06 to 0.13) in the relevant polishing temperature regime (i.e., G"/G' measured by shear dynamic mechanical analysis (DMA), ASTM D5279-08 (2008)). The unfilled polishing layer material of the present invention also has a high (>400 MPa) tensile modulus. The high shear storage modulus and low damping coefficient enables the CMP polishing layer to provide a high removal rate and excellent long length scale planarization needed for three dimensional semiconductor or memory substrates, such as non-volatile flash memory (3D NAND) substrates. In long length scale planarization, the CMP polishing layer of the present invention polishes three dimensional semiconductor or memory substrates having at least one low area having a width of 1 mm or longer, such as 1 to 5 mm.

The CMP polishing layers of the CMP polishing pads of the present invention are porous pad materials with significantly increased modulus at relevant temperatures and high flexural rigidity. These properties are achieved by using 4,4'-methylene-bis(3-chloro-2,6-diethylaniline) (MCDEA) as the curative or as at least 30 wt. %, or, preferably, at least 40 wt. % of the diamine curative mixture used in the thermosetting reaction mixture of the present invention. The addition of MCDEA to a curative mixture improves long length planarization by increasing modulus (shear storage modulus) and maintaining an adequate tan delta (damping component) in use conditions. For a given porosity, CMP polishing layers with increasing modulus exhibit improved flexural rigidity, which contributes to improved planarizing ability at longer length scales (>3 mm). Further, higher modulus at relevant substrate surface polishing temperatures typically corresponds to higher removal rate (RR). When compared to flexural rigidity, higher Tan delta or the damping component can also improve planarization, although to a greater extent at a shorter length scale (<1 mm). In the intermediate regime (1-5 mm), it is likely that both parameters contribute to planarizing ability and that Tan delta can be lower than in the shorter length scale regime. The CMP polishing temperature or regime may not overlap with the temperature of measurement of a given material property because measured platen temperatures may not accurately reflect the asperity temperatures in the polishing layer;

further, the polishing layer material is being subjected to variable strain rates in polishing The chemical mechanical polishing pads of the present invention comprise a polishing layer which is a homogenous dispersion of microelements in a porous polyurethane or a homogeneous polyurethane. Homogeneity is important in achieving consistent polishing pad performance, especially where a single casting is used to make multiple polishing pads. Accordingly, the reaction mixture of the present invention is chosen so that the resulting pad morphology is stable and easily reproducible. For example, it is often important to control additives such as anti-oxidizing agents, and impurities such as water for consistent manufacturing. Because water reacts with isocyanate to form gaseous carbon dioxide and a weak reaction product relative to urethanes generally, the water concentration can affect the concentration of carbon dioxide bubbles that form pores in the polymeric matrix as well as the overall consistency of the polyurethane reaction product. Isocyanate reaction with adventitious water also reduces the available isocyanate for reacting with chain extender, so changing the stoichiometry along with level of crosslinking (if there is an excess of isocyanate groups) and tends to lower resulting polymer molecular weight.

Porosity of the CMP polishing layer of the present invention may range from 0 to 53% or, preferably, from 8 to 40%, for example, from 12 to 25%. The polishing layer is more readily conditioned at a higher porosity but gives better rigidity and long length scale planarization at a lower porosity.

To insure homogeneity and good molding results and fill the mold completely, the reaction mixture of the present invention should be well dispersed.

In accordance with the present invention, a reaction mixture comprises, on one hand, at least a polyisocyanate prepolymer made from aromatic diisocyanate, for example, toluene diisocyanate, and the polyol component and, on the other hand, 4,4'-methylenebis(3-chloro-2,6-diethylaniline) (MCDEA) or MCDEA with 4,4'-methylene-bis-o-(2-chloroaniline) (MbOCA).

The polyurethane polymeric material or reaction product is preferably formed from, on the one hand, a polyisocyanate prepolymer reaction product of aromatic diisocyanates, such as toluene diisocyanate (TDI), with a polyol of polytetramethylene ether glycol (PTMEG), polypropylene glycol (PPG) or PTMEG blended with PPG and the curative.

The aromatic diisocyanate or aromatic and alicylic diisocyanate is partially reacted with the polyol blend to form a polyisocyanate prepolymer prior to producing the final polymer matrix.

The polyisocyanate prepolymer can further be combined with methylene diphenyl diisocyanate (MDI), or diol or polyether extended MDI or it can further be the reaction product of the aromatic diisocyanate, polyol and MDI or extended MDI, wherein MDI is present in the amount of from 0.05 to 20 wt. %, or, for example, up to 15 wt. % or, for example, from 0.1 to 12 wt. %, based on the total weight of the aromatic diisocyanates used to make the polyisocyanate prepolymer.

The polyisocyanate prepolymer can further be combined with methylene bis-cyclohexyl diisocyanate ($H_{12}$MDI), or diol or polyether extended $H_{12}$-MDI, or it can further be the product of the aromatic diisocyanate, polyol and $H_{12}$-MDI or extended $H_{12}$-MDI, wherein $H_{12}$-MDI is present in the amount of from 0.05 to 60 wt. %, or, for example, up to 53 wt. % or, for example, from 0.1 to 53 wt. %, based on the total weight of the aromatic and alicyclic diisocyanate used to make the polyisocyanate prepolymer. This combination can also be combined or reacted with from 0.05 to 20 wt. %, or, for example, up to 15 wt. % or, for example, from 0.1 to 12 wt. % of MDI, based on the total weight of the aromatic diisocyanates used to make the polyisocyanate prepolymer.

For clarity, the weight of MDI or $H_{12}$-MDI in the case of a diol or polyether extended MDI or $H_{12}$-MDI is considered to be the weight fraction of MDI or $H_{12}$-MDI itself in the extended MDI or $H_{12}$-MDI.

For purposes of this specification, the formulations are expressed in wt. %, unless specifically noted otherwise.

The polyisocyanate prepolymer of the present invention is the reaction product of a mixture containing the aromatic diisocyanate and a total of 30 to 66 wt. % or, preferably, 43 to 62 wt. %, such as from 45 to less than 62 wt. %, of the polyol blend (PPG and PTMEG), based on the total weight of reactants used to make the prepolymer. The remainder of the reaction mixture comprises the curative.

The polishing layer of the present invention is formed from reaction mixture of the polyisocyanate prepolymer and the curative, wherein the amount of the curative ranges from 23 to 33 wt. %, or, preferably, from 24 to 30 wt. %, based on the total weight of the reaction mixture.

A suitable polyisocyanate prepolymer is preferably formed from a mixture of toluene diisocyanate (TDI), i.e. as a partially reacted monomer, in the amount of from 16 to 46 wt. %, or, preferably, from more than 20 to 45 wt. %. For purposes of this specification, TDI monomer or partially reacted monomer represents the wt. % TDI monomer or TDI monomer reacted into a prepolymer before curing the polyurethane and does not include the other reactants that form the partially reacted monomer. Optionally, the TDI portion of the mixture may also contain some aliphatic isocyanate. Preferably, the diisocyanate component contains less than 15 wt. % aliphatic isocyanates and more preferably, less than 12 wt. % aliphatic isocyanate. Preferably, the mixture contains only impurity levels of aliphatic isocyanate. For clarity, an alicyclic diisocyanate is not consider to be an aliphatic isocyanate.

Available examples of PTMEG containing polyols are as follows: Terathane™ 2900, 2000, 1800, 1400, 1000, 650 and 250 from Invista, Wichita, Kans.; Polymeg™ 2900, 2000, 1000, 650 from Lyondell Chemicals, Limerick, Pa.; Poly-THF™ 650, 1000, 2000 from BASF Corporation, Florham Park, N.J. Available examples of PPG containing polyols are as follows: Arcol™ PPG-425, 725, 1000, 1025, 2000, 2025, 3025 and 4000 from Covestro, Pittsburgh, Pa.; Voranol™ 1010L, 2000L, and P400 from Dow, Midland, Mich.; Desmophen™ 1110BD or Acclaim™ Polyol 12200, 8200, 6300, 4200, 2200, each from Covestro.

Examples of commercially available PPG-containing isocyanate-terminated urethane prepolymers include Adiprene™ prepolymers (Chemtura), such as LFG 963A, LFG 964A, LFG 740D; Andur™ prepolymers (Anderson Development Company, Adrian, Mich.), such as, 7000 AP, 8000 AP, 6500 DP, 9500 APLF, 7501, or DPLF. Examples of suitable PPG-based prepolymers include Adiprene™ prepolymer LFG740D and LFG963A.

To increase the reactivity of a polyol with a diisocyanate or polyisocyanate to make a polyisocyanate prepolymer, a catalyst may be used. Suitable catalysts include, for example, oleic acid, azelaic acid, dibutyltindilaurate, 1,8-diazabicyclo[5.4.0]undec-7-ene (DBU), tertiary amine catalysts, such as Dabco TMR, and mixture of the above.

A suitable polyisocyanate prepolymer of the present invention has a viscosity in neat form of 10,000 mPa·s or less at 110° C. or, preferably, from 20 to 5,000 mPa·s.

Examples of suitable commercially available PTMEG containing isocyanate terminated urethane prepolymers include Imuthane™ prepolymers (available from COIM USA, Inc., West Deptford, N.J.) such as, PET-80A, PET-85A, PET-90A, PET-93A, PET-95A, PET-60D, PET-70D, or PET-75D; Adiprene™ prepolymers (Chemtura, Philadelphia, Pa.), such as, for example, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D or L325); Andur™ prepolymers (Anderson Development Company, Adrian, Mich.), such as, 70APLF, 80APLF, 85APLF, 90APLF, 95APLF, 60DPLF, 70APLF, or 75APLF.

In addition, the polyisocyanate prepolymers of the present invention may be low-free aromatic isocyanate prepolymers that have less than 0.1 wt. % each of free 2,4 and 2,6 TDI monomers and has a more consistent prepolymer molecular weight distribution than conventional prepolymers. "Low free aromatic isocyanate" prepolymers with improved prepolymer molecular weight consistency and low free isocyanate monomer content facilitate a more regular polymer structure, and contribute to improved polishing pad consistency.

Preferably, the polyurethane used in the formation of the polishing layer of the chemical mechanical polishing pad of the present invention is a low free isocyanate-terminated urethane having less than 0.1 wt % free toluene diisocyanate (TDI) monomer content.

To insure that the resulting pad morphology is stable and easily reproducible, for example, it is often important to control additives such as anti-oxidizing agents, and impurities such as water for consistent manufacturing. For example, because water reacts with isocyanate to form gaseous carbon dioxide, the water concentration can affect the concentration of carbon dioxide bubbles that form pores in the polymeric matrix. Isocyanate reaction with adventitious water also reduces the available isocyanate for reacting with the polyamine, so it changes the molar ratio of OH or $NH_2$ to NCO groups along with the level of crosslinking (if there is an excess of isocyanate groups) and resulting polymer molecular weight.

In the reaction mixture of the present invention, the stoichiometric ratio of the sum of the total amine ($NH_2$) groups and the total hydroxyl (OH) groups in the reaction mixture to the sum of the unreacted isocyanate (NCO) groups in the reaction mixture ranges from 0.85:1 to 1.2:1, or, preferably, 1.0:1 to 1.1:1.

The reaction mixture of the present invention is free of added organic solvents.

Preferably, the reaction mixture of the present invention is "substantially water free" (less than 2,000 ppm), based on the total weight of the reaction mixture.

In accordance with the methods of making the polishing layer of the present invention, the methods comprise providing the polyisocyanate prepolymer of the present invention at a temperature of from 45 to 65° C., cooling the prepolymer to from 20 to 40° C., or preferably, from 20 to 30° C., providing a curative and forming the thermosetting reaction mixture of the polyisocyanate prepolymer and, if desired, a microelement material as one component and the curative as another component, preheating a mold to from 60 to 100° C., or, preferably, from 65 to 95° C., filling the mold with the reaction mixture and heat curing the reaction mixture at a temperature of from 80 to 120° C. for a period of from 4 to 24 hours, or, preferably, from 6 to 16 hours to form a molded polyurethane reaction product.

The methods of forming the polishing layer of the present invention further comprise skiving or slicing the molded polyurethane reaction product to form a layer having a thickness of from 0.5 to 10 mm, or, preferably, from 1 to 3 mm.

The methods of making the polishing layer of the present invention enable the making of a low porosity pad from a reaction mixture that gives a large exotherm and cures unusually fast and makes a hard molded polyurethane reaction product. The cooling of the polyisocyanate prepolymer component and preheating of the mold prevents mold or cake popping, where the cured or cast material demolds from base and cannot be skived or sliced to form a polishing layer. In addition, the methods of making a CMP polishing pad of the present invention avoid heterogeneous secondary expansion of microelements and limits the variability of SG in the resulting mold or cake, thereby increasing the yield of polishing layers from the mold or cake after skiving or slicing.

The chemical mechanical polishing pads of the present invention can comprise just a polishing layer of the polyurethane reaction product or the polishing layer stacked on a subpad or sub layer. The polishing pad or, in the case of stacked pads, the polishing layer of the polishing pad of the present invention is useful in both porous and non-porous or unfilled configurations. Regardless of whether it is porous or non-porous, the finished polishing pad or polishing layer (in a stacked pad) preferably has a density of 0.7 to 1.20 g/cm$^3$ or, more preferably, from 0.9 to 1.08 g/cm$^3$. It is possible to add porosity through gas dissolution, blowing agents, mechanical frothing and introduction of hollow microspheres. Polishing pad density is as measured according to ASTM D1622-08 (2008). Density correlates closely, within 1-2% of specific gravity.

The porosity in the polishing layer of the present invention typically has an average diameter of 2 to 50 μm. Most preferably, the porosity arises from hollow polymeric particles having a spherical shape. Preferably, the hollow polymeric particles have a weight average diameter of 2 to 40 μm. For purposes of the specification, weight average diameter represents the diameter of the hollow polymeric particle before casting; and the particles may have a spherical or non-spherical shape. Most preferably, the hollow polymeric particles have a weight average diameter of 10 to 30 μm.

The polishing layer of the chemical mechanical polishing pad of the present invention optionally further comprises microelements which, preferably, are uniformly dispersed throughout the polishing layer. Such microelements, especially hollow spheres, may expand during casting. The microelements may be selected from entrapped gas bubbles, hollow core polymeric materials, such as polymeric microspheres, liquid filled hollow core polymeric materials, such as fluid filled polymeric microspheres, water soluble materials, an insoluble phase material (e.g., mineral oil), and abrasive fillers, such as boron nitride. Preferably, the microelements are selected from entrapped gas bubbles and hollow core polymeric materials uniformly distributed throughout the polishing layer. The microelements have a weight average diameter of less than 100 μm (preferably, from 5 to 50 μm). More preferably, the plurality of microelements comprise polymeric microspheres with shell walls of either polyacrylonitrile or a polyacrylonitrile copolymer (e.g., Expancel™ beads from Akzo Nobel, Amsterdam, Netherlands).

In accordance with the present invention, the microelements are incorporated into the polishing layer at from 0.4 to 2.5 wt. % porogen, or, preferably, 0.75 to 2.0 wt. %.

The polyurethane reaction product of the polishing layer of the chemical mechanical polishing pad of the present invention exhibits a Shore D hardness of 60 to 90 as measured according to ASTM D2240-15 (2015).

Preferably, the polishing layer used in the chemical mechanical polishing pad of the present invention has an average thickness of from 500 to 3750 microns (20 to 150 mils), or, more preferably, from 750 to 3150 microns (30 to 125 mils), or, still more preferably, from 1000 to 3000 microns (40 to 120 mils), or, most preferably, from 1250 to 2500 microns (50 to 100 mils).

The chemical mechanical polishing pad of the present invention optionally further comprises at least one additional layer interfaced with the polishing layer. Preferably, the chemical mechanical polishing pad optionally further comprises a compressible sub pad or base layer adhered to the polishing layer. The compressible base layer preferably improves conformance of the polishing layer to the surface of the substrate being polished.

The polishing layer of the chemical mechanical polishing pad of the present invention has a polishing surface adapted for polishing the substrate. Preferably, the polishing surface has macrotexture selected from at least one of perforations and grooves. Perforations can extend from the polishing surface part way or all the way through the thickness of the polishing layer.

Preferably, grooves are arranged on the polishing surface such that upon rotation of the chemical mechanical polishing pad during polishing, at least one groove sweeps over the surface of the substrate being polished.

Preferably, the polishing surface has macrotexture including at least one groove selected from the group consisting of curved grooves, linear grooves, perforations and combinations thereof.

Preferably, the polishing layer of the chemical mechanical polishing pad of the present invention has a polishing surface adapted for polishing the substrate, wherein the polishing surface has a macrotexture comprising a groove pattern formed therein. Preferably, the groove pattern comprises a plurality of grooves. More preferably, the groove pattern is selected from a groove design, such as one selected from the group consisting of concentric grooves (which may be circular or spiral), curved grooves, cross hatch grooves (e.g., arranged as an X-Y grid across the pad surface), other regular designs (e.g., hexagons, triangles), tire tread type patterns, irregular designs (e.g., fractal patterns), and combinations thereof. More preferably, the groove design is selected from the group consisting of random grooves, concentric grooves, spiral grooves, cross-hatched grooves, X-Y grid grooves, hexagonal grooves, triangular grooves, fractal grooves and combinations thereof. Most preferably, the polishing surface has a spiral groove pattern formed therein. The groove profile is preferably selected from rectangular with straight side walls or the groove cross section may be "V" shaped, "U" shaped, saw-tooth, and combinations thereof.

The methods of making a chemical mechanical polishing pad of the present invention may comprise providing a mold; pouring the reaction mixture of the present invention into the mold; and, allowing the combination to react in the mold to form a cured cake, wherein the polishing layer is derived from the cured cake. Preferably, the cured cake is skived to derive multiple polishing layers from a single cured cake. Optionally, the method further comprises heating the cured cake to facilitate the skiving operation. Preferably, the cured cake is heated using infrared heating lamps during the skiving operation in which the cured cake is skived into a plurality of polishing layers.

Another method of making a chemical mechanical polishing pad of the present invention can comprise a drawdown technique of mixing the curative in fluid form, preferably, as a melt, and the polyisocyanate prepolymer with any microelements in a vortex mixer at to form the thermosetting reaction mixture, followed by casting the mixture into a sheet using a drawdown bar or a doctor blade, for example, of 60 by 60 cm (24 by 24 inch) with a given thickness, for example, of 2 mm (80 mil) and curing. The microelements are mixed into the polyisocyanate prepolymer prior to the addition of the curative into the thermosetting reaction mixture. Curing can comprise heating an oven from ambient temperature to a set point temperature of 80 to 120° C., for example, 104° C., holding for, for example, 4 to 24 hours at the set point temperature, and then ramping of the oven set point temperature down to room temperature (21° C.) over a time, for example, a 2 hour ramp. The cured sheet can be faced, such as with a lathe.

In accordance with the methods of making polishing pads in accordance with the present invention, chemical mechanical polishing pads can be provided with a groove pattern cut into their polishing surface to promote slurry flow and to remove polishing debris from the pad-wafer interface. Such grooves may be cut into the polishing surface of the polishing pad either using a lathe or by a CNC milling machine.

In accordance with the methods of using the polishing pads of the present invention, the polishing surface of the CMP polishing pads can be conditioned. Pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". Polishing pad conditioning is typically achieved by abrading the polishing surface mechanically with a conditioning disk. The conditioning disk has a rough conditioning surface typically comprised of imbedded diamond points. The conditioning process cuts microscopic furrows into the pad surface, both abrading and plowing the pad material and renewing the polishing texture.

Conditioning the polishing pad comprises bringing a conditioning disk into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated.

The chemical mechanical polishing pad of the present invention can be used for polishing a substrate selected from at least one of a memory substrate and a semiconductor substrate.

The three dimensional semiconductor or memory substrates can have a feature scale or die scale of from 1-50 mm, preferred 1 to 20 mm between features needing planarized.

Preferably, the method of polishing a substrate of the present invention, comprises: providing a substrate selected from at least one of a three dimensional semiconductor or memory substrates, such as non-volatile flash memory (3D NAND) substrates; providing a chemical mechanical polishing pad according to the present invention; creating dynamic contact between a polishing surface of the polishing layer and the substrate to polish a surface of the substrate; and, conditioning of the polishing surface with an abrasive conditioner. In the methods of the present invention, the creating dynamic contact comprises polishing with a down force (DF) of from downforce (DF) of from 103 to 550 hPa (1.5 to 8 psi), or, preferably, from 206 to 483 hPa (3 to 7 psi). The DF can be higher 200 hPa to 550 hPa, preferably 275 hPa to 475 HPa for use with slurries with lower abrasive content in the range of from 0.5 to 2 wt. % abrasive, e.g. silica, solids. Also, the DF can be lower, such as from 103 to 344 hPa (1.5 to 5 psi) or, preferably, from 137 to 344 hPa (2 to 5 psi), for use with slurries with a higher abrasive content of from 2 to 6 wt. % or, preferably, from 2.5 to 5.5 wt. %.

EXAMPLES

The present invention will now be described in detail in the following, non-limiting Examples:

Unless otherwise stated all temperatures are room temperature (21-23° C.) and all pressures are atmospheric pressure (~760 mm Hg or 101 kPa).

Notwithstanding other raw materials disclosed below, the following raw materials were used in the Examples:

MONDUR™ Grade II TDI: Toluene Diisocyanate (Covestro Pittsburgh, Pa.);

TERATHANE™ 1000: Polytetramethylene ether glycol at 1000 Mw (Invista, Wichita, Kans.);

Adiprene™ LF 750D: Low free TDI (<0.5% max) prepolymer from PTMEG (8.75 to 9.05 wt. % NCO, Mn=760 Da; Mw=870 Da (Chemtura, Philadelphia, Pa.);

Adiprene™ L 325: TDI terminated liquid urethane prepolymer from PTMEG (8.95-9.25 wt. % NCO, Mn=990 Da; Mw=1250 Da, Chemtura);

Prepolymer A: $H_{12}$MDI-terminated liquid urethane quasi-prepolymer from PTMEG and TDI (~10.5% wt. % NCO) having ~64 wt. % of $H_{12}$MDI, based on the total weight of the aromatic and any alicyclic diisocyanates; Mn ~760 Da; Mw~870 Da;

Adiprene™ LFG 740D: Low free TDI (<0.5% max), TDI terminated liquid urethane prepolymer from polyol comprising PPG; (8.65-9.05 wt. % NCO, Chemtura);

MDI prepolymer: A linear isocyanate-terminated urethane prepolymer from methylene diphenyl diisocyanate (MDI) and the small molecules dipropylene glycol (DPG) and tripropylene glycol (TPG), with ~23 wt. % NCO content and equivalent weight of 182. 100 wt. % of this MDI prepolymer is treated as hard segment;

Lonzacure™ MCDEA: 4,4'-methylene-bis(3-chloro-2,6-diethylaniline), (Lonza Ltd., Switzerland);

Expancel™ 551 DE 40 d42 beads: Fluid filled polymeric microspheres with nominal diameter of 40 μm and true density of 42 g/l (Akzo Nobel, Arnhem, NL); and, Expancel™ 461DE 20 d70 beads: Fluid filled polymeric microspheres with nominal diameter of 20 μm and true density of 70 g/l (Akzo Nobel).

The following other abbreviations appear in the Examples, below:

TDI: Toluene diisocyanate (~80% 2,4 isomer, ~20% 2,6 isomer); MbOCA: 4,4'-Methylenebis(2-chloroaniline).

Example 1: Synthesis of CMP Polishing Layers and Pads

Polishing layers comprising the reaction product of the reaction mixture formulations as set forth in Table 1, below, were formed by casting the formulations into polytetrafluorethylene (PTFE-coated) circular molds 86.36 cm (34") in diameter having a flat bottom to make moldings for use in making polishing pads or polishing layers. To form the formulations, the indicated polyisocyanate prepolymer heated to 52° C. to insure adequate flow and having in it the indicated microelements, as one component, and the curative, as another component were mixed together using a high shear mix head. After exiting the mix head, the formulation was dispensed over a period of 2 to 5 minutes into the mold to give a total pour thickness of 4 to 10 cm and was allowed to gel for 15 minutes before placing the mold in a curing oven. The mold was then cured in the curing oven using the following cycle: 30 minutes ramp from ambient temperature to a set point of 104° C., then hold for 15.5 hours at 104° C., and then 2 hour ramp from 104° C. to 21° C.

To cast the reaction mixture formulations as cakes, the pads were cast using a prepolymer line heat exchanger to reduce the prepolymer casting temperature to the indicated temperature from 52° C. to 27° C. (80° F.), and the molds were preheated to 93° C., this enables control of the high exotherm to mitigate variation within the mold Porosity is proportional to microsphere loading and inversely proportional to SG.

TABLE 1

Reaction Mixtures

| Pad | Prepolymer | Curative 1 | Curative 2 | Curative1:Curative2 | Total Stoich (%) | Porosity (vol %) | Nominal Pore Size |
|---|---|---|---|---|---|---|---|
| A* | L 325 | MbOCA | — | — | 87 | 35% | 40 |
| B* | L 325 | MbOCA | — | — | 105 | 37% | 20 |
| C* | LF 750D and MDI Prepolymer | MbOCA | — | — | 105 | 19% | 20 |
| D | LF 750D | — | MCDEA | — | 105 | 17% | 20 |
| E* | LF 750D | MbOCA | — | — | 105 | 19% | 20 |
| F* | LFG 740D and LF 750D (4:1) | MbOCA | — | — | 105 | 16% | 20 |
| G | LF 750D | MbOCA | MCDEA | 1:1 | 105 | 18% | 20 |
| H | L 325 | — | MCDEA | — | 105 | 17% | 20 |
| I | L 325 and Prepolymer A (1:1) | — | MCDEA | — | 105 | 20% | 20 |

*Denotes Comparative Example.

The cured polyurethane cakes were then removed from the mold and skived (cut using a stationary blade) at a temperature of from 70 to 90° C. into approximately thirty separate 2.0 mm (80 mil) thick sheets. Skiving was initiated from the top of each cake. Any incomplete sheets were discarded.

The ungrooved, polishing layer materials from each example were analyzed to determine their physical properties. Note that the pad density data reported were determined according to ASTM D1622-08 (2008); the Shore D hardness data reported were determined according to ASTM D2240-15 (2015); and, the modulus and elongation to break data reported were determined according to ASTM D412-6a (2006). Test results are shown in Tables 2, 3, 4, 5 and 6, below.

Test Methods:

Including property tests indicated above, the following methods were used to test the polishing pads:

Polishing:

Chemical mechanical polishing pads were constructed using polishing layers. These polishing layers were then machine grooved to provide a groove pattern in the polishing surface comprising perforations or a plurality of concentric circular grooves having the following dimensions: In Examples 2 and 3, perforated pads were used which had a Suba™ 400 urethane sized polyester mat sub pad (Nitta Haas, JP); in Example 4, 1010 grooves of 0.76 mm (30 mil) depth, 0.51 mm (20 mil) width, and 3.05 mm (120 mil) pitch.

The polishing layers were then laminated to a foam sub-pad layer (SUBA IV available from Rohm and Haas Electronic Materials CMP Inc.). The resulting pads were mounted to the polishing platen of the indicated polisher using a double sided pressure sensitive adhesive film.

A CMP polishing platform, indicated below, was used to polish the indicated substrates with the indicated pads. The indicated polishing medium used in the polishing experiments (e.g. a CES333F ceria slurry, Asahi Glass Company, JP). Unless otherwise indicated (as platen rpm (PS)/carrier rpm (CS)), the polishing conditions used in all of the polishing experiments included a platen speed of 93 rpm; a carrier speed of 87 rpm; with a polishing medium flow rate of 200 mL/min and with the indicated down force (DF). An AM02BSL8031C1-PM (AK45) diamond conditioning disk (Saesol Diamond Ind. Co., Ltd.) was used to condition the chemical mechanical polishing pads. The chemical mechanical polishing pads were each broken in with the conditioner using a down force of 3.2 kg (7 lbs) for 40 minutes. The polishing pads were further conditioned in situ using a down force of 3.2 kg (7 lbs). The removal rates (RR) were determined by measuring the film thickness before and after polishing using a FX200 metrology tool (KLA-Tencor, Milpitas, Calif.) using a 49 point spiral scan with a 3 mm edge exclusion.

Step Height:

Measured difference in low area and feature level, as determined by optical interference using a RE-3200 Ellipsometric Film Thickness Measurement System (Screen Holdings Co. Ltd., JP). Desirably, the remaining step height is as low as possible.

Example 2: Ceria Slurry Polishing on a Wafer Substrate

In Table 2, below, the indicated CMP polishing pads were tested in polishing, as defined above, with a FREX™300 polishing platform (Ebara, Tokyo, JP) at a 410 hPa (6 psi) downforce using a Hitachi HS8005 ceria slurry (Hitachi, Corp., JP) at 0.5 wt. % final solids (1:9 dilution), 240 nm (d50) and pH ~8.4 and the substrate was a tetraethoxy orthosilicate (TEOS) oxide film on a patterned polysilicon wafer. Prior to polishing, the indicated CMP polishing pads were subject to 30s ex-situ conditioning at a 100N DF using a Kinik EP1AG-150730-NC™ conditioning disk (Kinik, Taipei, TW).

TABLE 2

Removal Rates With a Ceria Slurry

| Pad | Removal Rate (Å/min) | Step Height at 250 μm | Step Height at 4 mm | Polish Temp. (° C.) | G' @ 50° C. (MPa) | G' @ 65° C. (MPa) | G' @ 90° C. (MPa) |
|---|---|---|---|---|---|---|---|
| A*,1 | 5174 | 1300 | 3900 | 61 | 184 | 131 | 79 |
| B* | 5891 | 1100 | 3400 | 64 | 208 | 142 | 80 |
| H | 6503 | 1500 | 3100 | 65 | 264 | 203 | 138 |
| F* | 4109 | 800 | 2900 | 53 | 146 | 108 | 73 |
| I | 6975 | 1500 | 3900 | 73 | 296 | 240 | 183 |

*Denotes Comparative Example; 1. IC1000 pad (Dow) made using ADIPRENE ™ L325 prepolymer (Chemtura).

As shown in Table 2, above, the CMP polishing pads H and I of the present invention gave a dramatically higher removal rate than that of the closest art in CMP polishing pads A and B.

Example 3: Ceria Slurry Polishing on a Feature Substrate

In Table 3, below, the indicated CMP polishing pads were tested in polishing as defined in Example 2, above, at a 500 hPa (7.25 psi) DF with a Hitachi HS8005™ ceria slurry at 0.5 wt. % final solids (1:9 dilution), 240 nm (d50) and pH ~8.4, except at a platen/carrier speed (100/107 rpm) and the substrate was a tetraethoxy orthosilicate (TEOS) oxide film on a patterned polysilicon wafer.

TABLE 3

Removal Rates and Length Scale Planarization With a Ceria Slurry

| Pad | Removal Rate (Å/min) | Step Height at 250 μm | Step Height at 4 mm | Polish Temp. (° C.) | G' @ 50° C. (MPa) | G' @ 65° C. (MPa) | G' @ 90° C. (MPa) |
|---|---|---|---|---|---|---|---|
| A*,1 | 5380 | 1300 | 4400 | 74 | 184 | 131 | 79 |
| B* | 7640 | 1200 | 4250 | 84 | 208 | 142 | 80 |
| C* | 8250 | 900 | 3800 | 83 | 349 | 224 | 68 |
| D | 10560 | 1700 | 3900 | 88 | 255 | 220 | 184 |
| E* | 5990 | 800 | 3650 | 76 | 123 | 83 | 55 |
| F* | 4930 | 800 | 3400 | 70 | 146 | 108 | 73 |

*Denotes Comparative Example; 1. IC1000 pad (Dow).

As shown in Table 3, above, the preferred CMP polishing pad D of the present invention has a dramatically higher removal rate than that of the closest art in CMP polishing pad E, which is made from the same polyisocyanate prepolymer at the same stoichiometry, however, without the curative of the present invention.

Example 4: Polishing at Various Removal Rates

In Table 4, below, the indicated CMP polishing pads were tested in polishing as defined above with an Ebara Reflexion polishing device (300 mm, Ebara) and using a ceria slurry (pH 3.5 and 150 nm average particle size) at 6 wt. % solids, at the indicated carrier/platen speed and at the indicated downforce (DF). The substrate was a tetraethoxy orthosilicate (TEOS) oxide film on a patterned polysilicon wafer.

TABLE 4

Removal Rates and Long Length Scale Planarization With a Ceria Slurry at Various Downforces

| Pad | Polishing DF SI Units (psi) | PS/CS (rpm) | Removal Rate (Å/min) | Step Height at 50% PD[2] | Polish Temp (° C.) |
|---|---|---|---|---|---|
| A*,[1] | 2.0 | 110/103 | 8900 | | 54 |
| D | 2.0 | 110/103 | 9000 | | 53 |
| G | 2.0 | 110/103 | 9100 | | 53 |
| A*,[1] | 2.5 | 110/103 | 10600 | 820 | 60 |
| D | 2.5 | 110/103 | 11000 | 370 | 59 |
| G | 2.5 | 110/103 | 11000 | 0 | 58 |
| A*,[1] | 3.0 | 110/103 | 12000 | | 66 |
| D | 3.0 | 110/103 | 12900 | | 65 |
| G | 3.0 | 110/103 | 12900 | | 65 |
| A*,[1] | 2.3 | 123/117 | 10600 | | 53 |
| G | 2.3 | 123/117 | 11100 | | 53 |
| A*,[1] | 3.0 | 123/117 | 12600 | | 62 |
| G | 3.0 | 123/117 | 13900 | | 63 |
| A*,[1] | 3.5 | 123/117 | 13800 | | 67 |
| G | 3.5 | 123/117 | 15200 | | 68 |
| A*,[1] | 4.0 | 123/117 | 14400 | | 72 |
| G | 4.0 | 123/117 | 16800 | | 73 |

*Denotes Comparative Example;
[1]IC1000 pad (Dow);
[2]Pattern Density.

As shown in Table 4, above, the CMP polishing pads D and G of the present invention give a higher removal rate than that of the art in CMP polishing pad A, which is not made with the curative of the present invention or at the stoichiometry of the present invention. The pad G made from a MCDEA, MbOCA curative blend gave the best results. Step height data taken at a 172 hPa (2.5 psi DF) indicates that the pad of the present invention improves long length scale planarity. RR data shows that there is increased improvement for the inventive pads when compared to the comparative polishing pad at an increasing DF and at increasing platen/carrier speeds.

We claim:

1. A chemical mechanical (CMP) polishing pad having a low damping component for polishing a substrate chosen from at least one of a memory and a semiconductor substrate comprising: a polishing layer adapted for polishing the substrate which is a polyurethane reaction product of a thermosetting reaction mixture comprising a curative of 4,4'-methylenebis(3-chloro-2,6-diethylaniline) (MCDEA) or mixtures of MCDEA and 4,4'-methylene-bis-o-(2-chloroaniline) (MbOCA) in a weight ratio of MCDEA to MbOCA of from 3:7 to 1:0, and a polyisocyanate prepolymer having an unreacted isocyanate (NCO) concentration of from 8.6 to 11 wt. % and formed from one or two aromatic diisocyanates or a mixture of an aromatic diisocyanate and up to 67 wt. % of an alicyclic diisocyanate, based on the total weight of the aromatic and alicyclic diisocyanates, and a polyol of polytetramethylene ether glycol (PTMEG), polypropylene glycol (PPG), or a polyol blend of PTMEG and PPG as reactants, wherein the polyurethane reaction product in the polishing layer has a Shore D hardness according to ASTM D2240-15 (2015) of from 60 to 90, further wherein the polyurethane reaction product in the polishing layer has a shear storage modulus (G') at 65° C. of from 125 to 500 MPa, and, still further wherein the polishing layer has a damping component (G"/G' measured by shear dynamic mechanical analysis (DMA), ASTM D5279-08 (2008)) at 50° C. of from 0.06 to 0.13.

2. The CMP polishing pad as claimed in claim 1, wherein the curative comprises a mixture of MCDEA and 4,4'-methylene-bis-o-(2-chloroaniline) (MbOCA) in a weight ratio of MCDEA to MbOCA of from 4:6 to 1:0.

3. The CMP polishing pad as claimed in claim 1, wherein the aromatic diisocyanate or mixture thereof with an alicyclic diisocyanate is chosen from toluene diisocyanate (TDI), TDI mixed with up to 20 wt. %, based on the total weight of the aromatic diisocyanate, of methylene diphenyl diisocyanate (MDI), or a mixture of TDI and up to 67 wt. % of $H_{12}$MDI, based on the total weight of the aromatic and alicyclic diisocyanates.

4. The CMP polishing pad as claimed in claim 1, wherein the polyisocyanate prepolymer has an unreacted isocyanate (NCO) concentration of from 8.6 to 10.3 wt. % of the polyisocyanate prepolymer, wherein the polyol used to form the polyisocyanate prepolymer is chosen from (i) PTMEG, (ii) PPG or (iii) a polyol blend of PTMEG and PPG in a ratio of PTMEG to PPG of from 1:0 to 1:4, or, for example, from 12:1 to 1:1.

5. The CMP polishing pad as claimed in claim 1, wherein the stoichiometric ratio of the sum of the total moles of amine ($NH_2$) groups and the total moles of hydroxyl (OH) groups in the reaction mixture to the total moles of unreacted isocyanate (NCO) groups in the reaction mixture ranges from 0.90:1 to 1.20:1.

6. The CMP polishing pad as claimed in claim 1, wherein the polishing layer of the CMP polishing pad further comprises microelements chosen from entrapped gas bubbles, hollow core polymeric materials, liquid filled hollow core polymeric materials, and fillers.

7. The CMP polishing pad as claimed in claim 6, wherein the polishing pad or polishing layer has a porosity of from 0.01 to 53%.

8. The CMP polishing pad as claimed in claim 1, wherein the polishing pad or polishing layer has a density of 0.55 to 1.17 g/cm$^3$.

9. The CMP polishing pad as claimed in claim 1, wherein the polishing layer comprises a polyurethane reaction product having a hard segment of from 45 to 70%, based on the total weight of the thermosetting reaction mixture.

10. A method of chemical mechanical (CMP) polishing a substrate, comprising: Providing a substrate selected from at least one of a three dimensional semiconductor or memory substrate; providing a chemical mechanical (CMP) polishing pad as claimed in claim 1; providing an abrasive polishing medium; and creating dynamic contact between a polishing surface of the polishing layer of the CMP polishing pad, the abrasive polishing medium and the substrate to polish a surface of the substrate at a downforce (DF) of from 103 to 550 hPa (1.5 to 8 psi); and, conditioning of the polishing surface of the polishing pad with an abrasive conditioner.

* * * * *